US009085908B2

(12) United States Patent
Deschênes

(10) Patent No.: US 9,085,908 B2
(45) Date of Patent: Jul. 21, 2015

(54) STRIP WITH RESILIENT BRACES FOR FASTENING PERPENDICULARLY ATTACHED SIDING PANELS

(75) Inventor: Philippe Deschênes, Montreal (CA)

(73) Assignee: Deschênes Innovations Inc. (CA)

( * ) Notice: Subject to any disclaimer, the term of this patent is extended or adjusted under 35 U.S.C. 154(b) by 0 days.

(21) Appl. No.: 13/574,259

(22) PCT Filed: Jan. 27, 2011

(86) PCT No.: PCT/CA2011/000099

§ 371 (c)(1),
(2), (4) Date: Jul. 20, 2012

(87) PCT Pub. No.: WO2011/091518

PCT Pub. Date: Aug. 4, 2011

(65) Prior Publication Data

US 2012/0292474 A1 Nov. 22, 2012

Related U.S. Application Data

(60) Provisional application No. 61/298,719, filed on Jan. 27, 2010.

(51) Int. Cl.
*F16B 5/07* (2006.01)
*E04F 13/08* (2006.01)

(52) U.S. Cl.
CPC ..... *E04F 13/0864* (2013.01); *E04F 13/0803* (2013.01); *Y10T 29/49826* (2015.01)

(58) Field of Classification Search
CPC ..... E04F 13/0864; E04F 13/0803; E04F 13/0841; E04F 13/0842; E04F 13/0846; E04F 13/0812; E04F 13/0876; E04F 13/0805; E04D 1/34; E04D 12/004; E04D 1/18; E04D 3/363
USPC ..... 52/543, 546, 547, 551, 552, 520, 521, 52/475.1, 476, 478, 483.1, 489.1, 512, 52/462, 747.1, 748.1
See application file for complete search history.

(56) References Cited

U.S. PATENT DOCUMENTS 2,044,216 A * 6/1936 Klages ..... 52/774
3,131,513 A * 5/1964 Grigas et al. ..... 52/520

(Continued)

FOREIGN PATENT DOCUMENTS

FR 2928672 9/2009
JP H0518085 1/1993

(Continued)

OTHER PUBLICATIONS

PCT—International Search Report (ISR)—PCT/CA2011/000099 (Form PCT/ISA/210)—Apr. 28, 2011—4 pages.

*Primary Examiner* — Brian Glessner
*Assistant Examiner* — Adam Barlow
(74) *Attorney, Agent, or Firm* — Benoît & Côté Inc.

(57) ABSTRACT

The present document describes a fastening strip for fastening a plurality of siding panels to a surface. The strip is installed on the surface perpendicularly to the length of the panels. The strip has a plurality of braces regularly spaced along the strip and extending outwardly therefrom. Each one of the siding panels fits between two consecutive braces which each have a flexible portion and an engaging portion. The flexible portion for engaging the first edge of one of the siding panels and the engaging portion for engaging the second edge of one of the siding panels thereby fastening the one of the siding panels to the surface in between two braces.

20 Claims, 15 Drawing Sheets

(56) References Cited

U.S. PATENT DOCUMENTS

| | | | | | |
|---|---|---|---|---|---|
| 3,236,932 | A | * | 2/1966 | Grigas et al. | 52/543 |
| 3,321,883 | A | | 5/1967 | Pascucci | |
| 3,903,670 | A | * | 9/1975 | Robinson, Jr. | 52/478 |
| 4,047,349 | A | * | 9/1977 | Aguilar, Jr. | 52/551 |
| 4,134,244 | A | * | 1/1979 | Sjolander | 52/506.1 |
| 4,288,958 | A | * | 9/1981 | Chalmers et al. | 52/478 |
| 4,288,959 | A | | 9/1981 | Murdock | |
| 4,961,295 | A | * | 10/1990 | Kosch et al. | 52/36.5 |
| 5,018,323 | A | | 5/1991 | Clausen | |
| 5,150,555 | A | * | 9/1992 | Wood | 52/544 |
| 6,044,609 | A | * | 4/2000 | Kim | 52/551 |
| 6,164,467 | A | * | 12/2000 | DePottey et al. | 211/189 |
| 6,430,885 | B1 | | 8/2002 | Ito | |
| 6,725,618 | B2 | * | 4/2004 | Albracht | 52/489.1 |
| 7,823,350 | B2 | * | 11/2010 | Valle et al. | 52/356 |
| 8,096,091 | B2 | * | 1/2012 | Cristina | 52/551 |
| 2006/0213142 | A1 | * | 9/2006 | Albracht | 52/543 |

FOREIGN PATENT DOCUMENTS

| | | | |
|---|---|---|---|
| JP | 05044323 | | 2/1993 |
| JP | 06264588 | | 9/1994 |
| JP | 09256591 | A | 9/1997 |
| JP | H09256591 | | 9/1997 |
| JP | 10183939 | | 7/1998 |
| JP | H10183939 | | 7/1998 |
| JP | 2003056072 | | 2/2003 |

* cited by examiner

STRIP WITH RESILIENT BRACES FOR FASTENING PERPENDICULARLY ATTACHED SIDING PANELS

CROSS-REFERENCE TO RELATED APPLICATIONS

This application claims priority from U.S. Provisional Application No. 61/298,719 Filed on Jan. 27, 2010.

TECHNICAL FIELD

This description relates to the field of construction materials. More particularly, this description relates to fasteners for fastening siding panels to a surface of a building.

BACKGROUND

Usually, building sidings are made of an alignment of boards laterally joined to cover a side or a portion of a side of a building. Boards can be made of genuine wood, fiber cement, vinyl or other composite materials. Boards are designed for protection the exterior of a building while acting as a design element. Boards can be disposed at any angle with respect to the ground.

Traditionally, boards are perpendicularly nailed to studs disposed on the wall. Two or more workers are necessary to position a board and to nail it. Most often, especially for genuine wood boards, nails are used to install the boards using a manual hammer. A pneumatic or electrical hammer will often split the wood. Also, boards must be parallel to each other, so a line must be drawn on the wall regularly to keep them all level. Moreover, ends of board must be cut to correspond to a stud.

Some systems allow nailing additional individual pieces to walls by pneumatic or electrical hammer. Each additional piece has to be nailed individually and gradually as the installation of the boards progresses. These pieces must also be individually aligned with each other horizontally.

There is therefore a need for improved fasteners for fastening siding panels.

SUMMARY

It is an object of the present disclosure to provide a fastening device that overcomes or mitigates one or more disadvantages of known fasteners or at least provides a useful alternative.

According to an embodiment, there is provided a fastening device for fastening siding panels to a surface, each one of the siding panels comprising a first edge and a second edge, the fastening device comprising a strip for attachment to the surface; and braces spaced along the strip and extending outwardly therefrom, at least one of the braces for engaging the first edge of one of the siding panels, the braces each comprising an engaging portion and a flexible portion, the engaging portion extending from the flexible portion, wherein while fastening the one of the siding panels to the surface, the second edge of the one of the siding panels is secured in place, then the first edge of the one of the siding panels is pushed against the at least one of the braces to displace the engaging portion toward the surface until the first edge of the one of the siding panels is engaged in the engaging portion thereby fastening the one of the siding panels to the surface.

According to an embodiment, there is provided the fastening device above, wherein the braces are regularly spaced along the strip.

According to an embodiment, there is provided the fastening device above, wherein the braces are irregularly spaced along the strip.

According to an embodiment, there is provided the fastening device above, wherein the braces comprise two braces to form a union part to join two siding panels in an end-to-end relationship.

According to an embodiment, there is provided the fastening device above, wherein the strip and braces are made from the same piece of material and form a single unitary part.

According to an embodiment, there is provided the fastening device above, wherein the braces are cutout and folded from the same piece of material, the braces thereby comprising folds.

According to an embodiment, there is provided the fastening device above, wherein the folds comprise at least two folds, namely a first fold and a second fold.

According to an embodiment, there is provided the fastening device above, wherein the flexible portion is comprised between the first and the second folds.

According to an embodiment, there is provided the fastening device above, wherein a distance between the first and the second folds is greater than a distance between any consecutive folds thereafter or than a length of material on the brace after a last fold thereby ensuring that the flexible portion will flex to displace the engaging portion.

According to an embodiment, there is provided the fastening device above, wherein the same unitary piece of material comprises steel.

According to an embodiment, there is provided the fastening device above, wherein the braces each further comprise a substantially planar push portion on which the first edge of the one of the siding panels is pushed against to displace the engaging portion toward the surface.

According to an embodiment, there is provided the fastening device above, wherein the substantially planar push portion is in a first plane and the flexible portion is in a second plane which is substantially parallel to the first plane.

According to an embodiment, there is provided the fastening device above, wherein the strip comprises a portion for being perforated by nails for fixing the strip on the surface.

According to an embodiment, there is provided the fastening device above, wherein the strip comprises a visual indicator disposed at a fixed longitudinal distance of each brace for making easier the positioning of the fastening device on the surface.

According to an embodiment, there is provided the fastening device above, wherein the strip has a longitudinal direction and the markings comprise pairs of markings wherein the markings in each of the pairs of markings form a line that is perpendicular to the longitudinal direction of the strip.

According to an embodiment, there is provided the fastening device above, wherein the strip has a longitudinal direction and the braces have a width in a direction which is perpendicular to the longitudinal direction of the strip and wherein the first edge of the one of the siding panels is parallel to a longitudinal direction of the one of the siding panels, the longitudinal direction of the strip and the longitudinal direction of the siding panels are therefore generally perpendicular to each other.

According to an embodiment, there is provided the fastening device above, wherein the strip is for vertical attachment to the surface while the siding panels are for horizontal installation.

According to an embodiment, there is provided a method for fastening to a surface, siding panels comprising a first edge and a second edge a comprising: installing, on the surface and at the same level, identical longitudinal fastening devices each comprising braces; securing the second edge of a siding panel along the surface and perpendicularly to the longitudinal fastening devices; pushing, in a rotation movement about the second edge, the first edge of the siding panel against one of the braces to displace the one of the braces toward the surface until the one of the braces springs back to its original position and the first edge is engaged in the one of the braces thereby fastening the one of the siding panels to the surface; and repeating the securing and pushing steps for the siding panel to be fastened immediately adjacent the first edge of an installed siding panel until the surface is covered.

According to an embodiment, there is provided the method above, further comprising installing a starting strip on the surface in the same longitudinal direction as the intended longitudinal direction of the siding panels, and wherein the installing the identical longitudinal fastening devices comprises leaning a bottom end of the identical longitudinal fastening devices against a top edge of the starting strip during installation thereof to the surface thereby ensuring all braces on a given identical longitudinal fastening devices are aligned with the braces of other identical longitudinal fastening devices.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
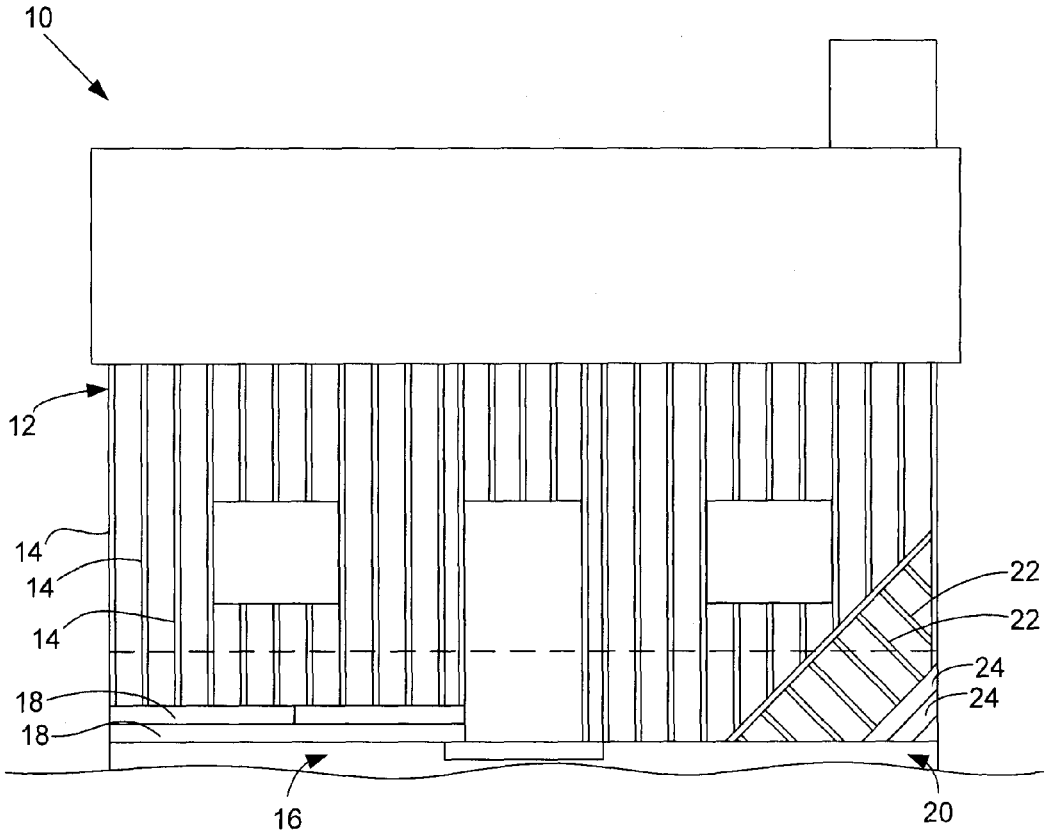
FIG. 1 is a front elevation view of a house partially covered with siding panels in accordance to an embodiment.

Referring now to the drawings, and more particularly to FIG. 1, there is shown a building 10 having an outside surface 12 covered with parallel strapping 14 regularly or irregularly fixed on the surface 12. On the lower left part 16 of the surface 12, siding panels 18, such as siding boards, tiles, rock imitation panels and the like, are horizontally fastened to strapping 14. On the lower right part 20 of the surface 12, strapping 22 are shown inclined with respect to the ground. It will be shown that siding panels 18 are installed perpendicularly to the strapping 22.

Figure 1A:
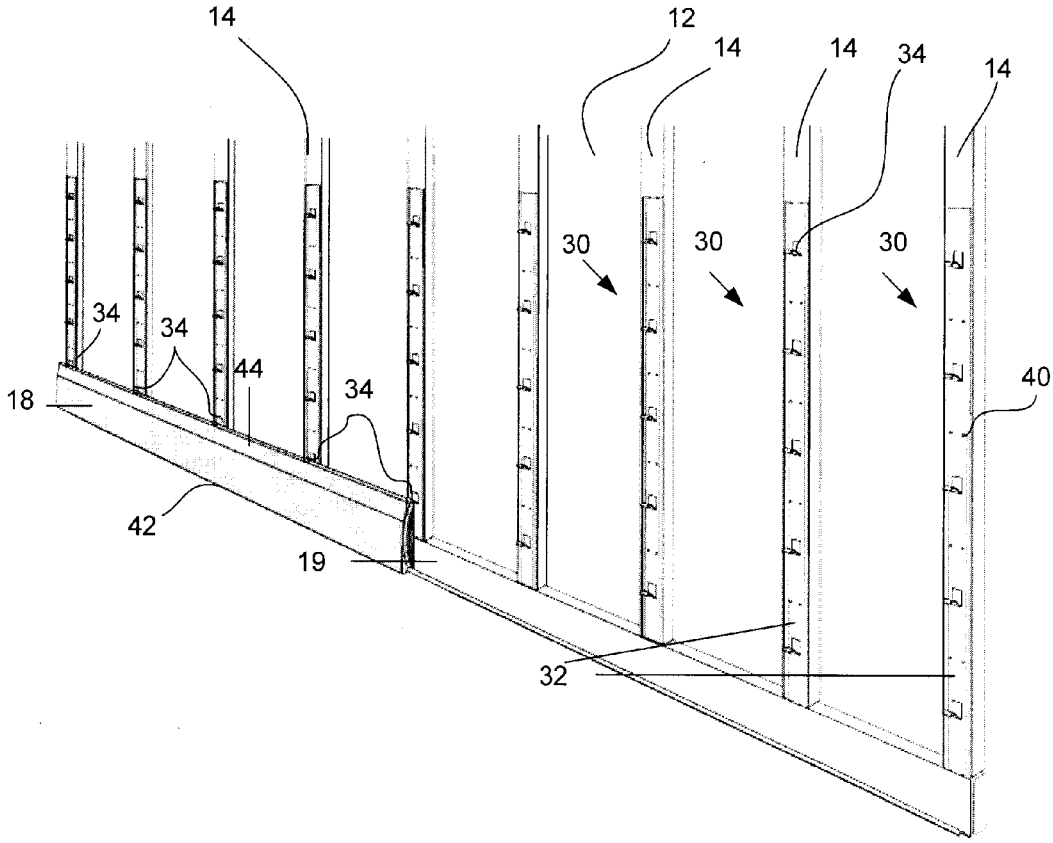
FIG. 1A is a partial view of a structure on which a fastening device is installed according to an embodiment.
Figure 2:
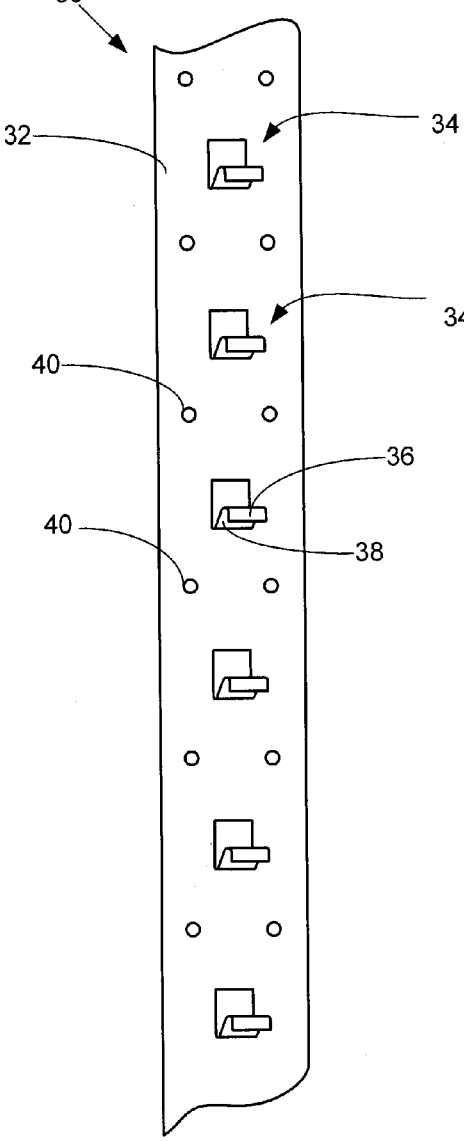
FIG. 2 is a partial perspective view of a fastening device according to an embodiment.
Figure 2A:
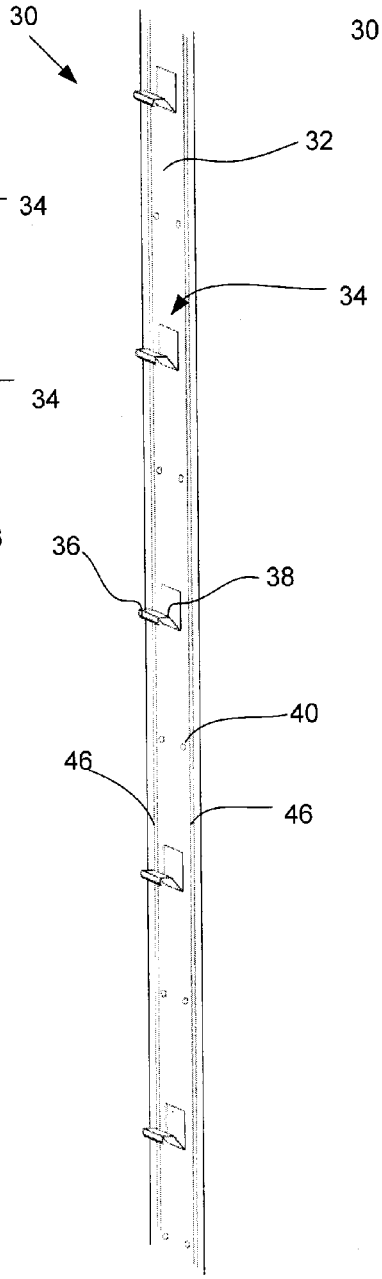
FIGS. 2A and 2B are partial perspective views of a fastening device according to different embodiments.

FIG. 1A illustrates a structure with fastening devices 30 on strapping 14. As shown in FIGS. 1A, 2 and 2A, there is shown a fastening device 30 for fastening siding panels 18 to a surface 12. In the embodiment of FIG. 1A, the surface 12 comprises strapping 14. In the other embodiments, strapping 14 is not required. There is also shown in FIG. 1A the starting strip 19 to be installed on the structure 15 to allow the installation of all the fastening devices 30 on the strapping 14 at the same level.

Figure 2B:
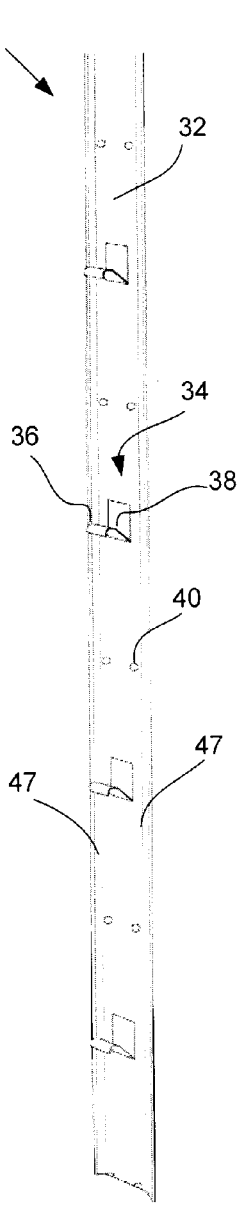

The fastening device 30 also includes ridges 46 (FIG. 2A) or wings 47 (FIG. 2B) for exerting a positive outward pressure on the siding panels 18 once installed. The positive outward pressure may also be exerted on the siding panels 18 using other means such as cut-out extensions similar to braces 34 (not shown). All positive pressure means such as ridges 46 or wings 47 act to provide an air space behind the siding panels 18.

Figure 2C:
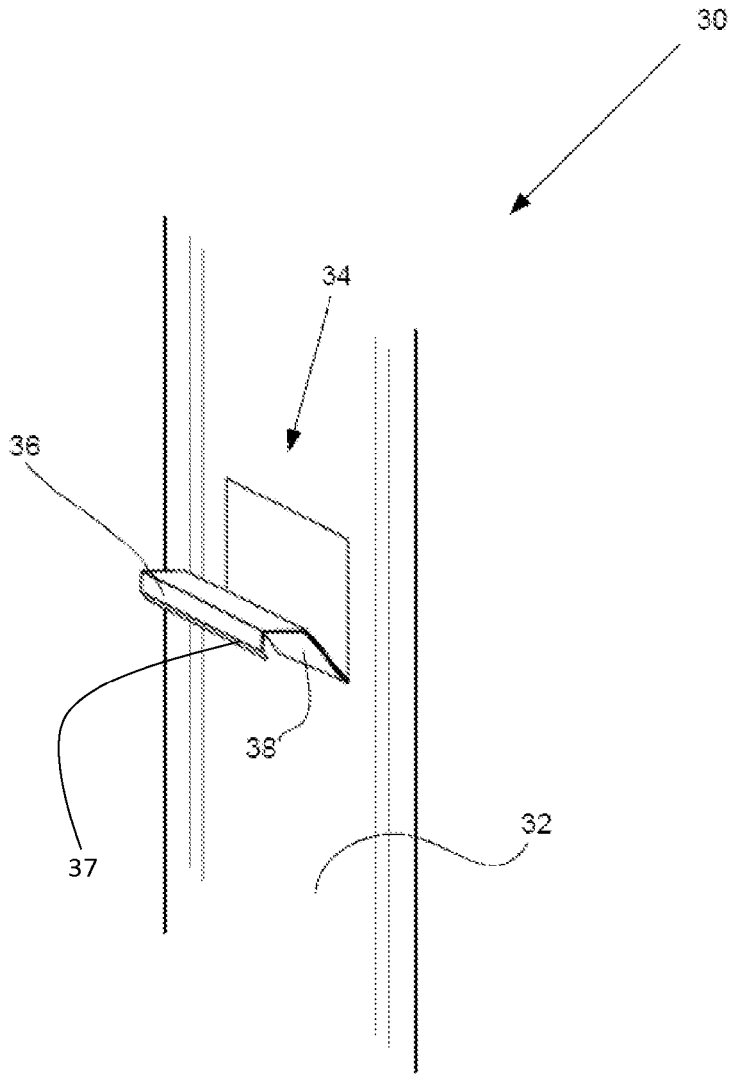
FIG. 2C is a close-up view of one brace of the fastening device of FIG. 2A or 2B.

According to an embodiment, the fastening device 30 is made of rigid material such as sheet metal comprising steel. The fastening device 30, shown in the embodiments of FIGS. 1 to 2C, is meant to be installed on strapping 14 or strapping 22 of FIG. 1. The fastening device 30 can be installed to strapping 14 or 22 using nails installed by hand or using a pneumatic gun. Any other means for fixing fastening device 30 to strapping 14 or 22 such as screws, glue, double-side or single-side tape, etc., or any combination thereof is acceptable.

As shown in FIGS. 2, 2A, 2B and 2C, on the fastening device 30, braces 34 are regularly or irregularly disposed along the strip 32. Each brace 34 has a flexible portion 38 and an engaging portion 36. Each portion is for engaging one edge of siding panels 18 as shown in more detail in FIG. 3. The strip 32 further comprises a plurality of markings 40 (FIGS. 2 and 2A), each disposed at a fixed longitudinal distance from a brace 34. Each marking 40 acts as a visual indicator to facilitate the positioning of the fastening device 30 on the surface 12. A portion 37 extends inward from engaging portion 36 toward a vertical wall surface.

A person skilled in the art will understand that the function of the markings 40 may be implemented by other means than those shown in FIG. 2. For example, there could only be one bore between each brace 34. The markings 40 could also be replaced by any type of marking, such as a line, a dot or dots, bores, etc., as long as it is disposed at a fixed longitudinal distance from a brace 34.

Figure 3:
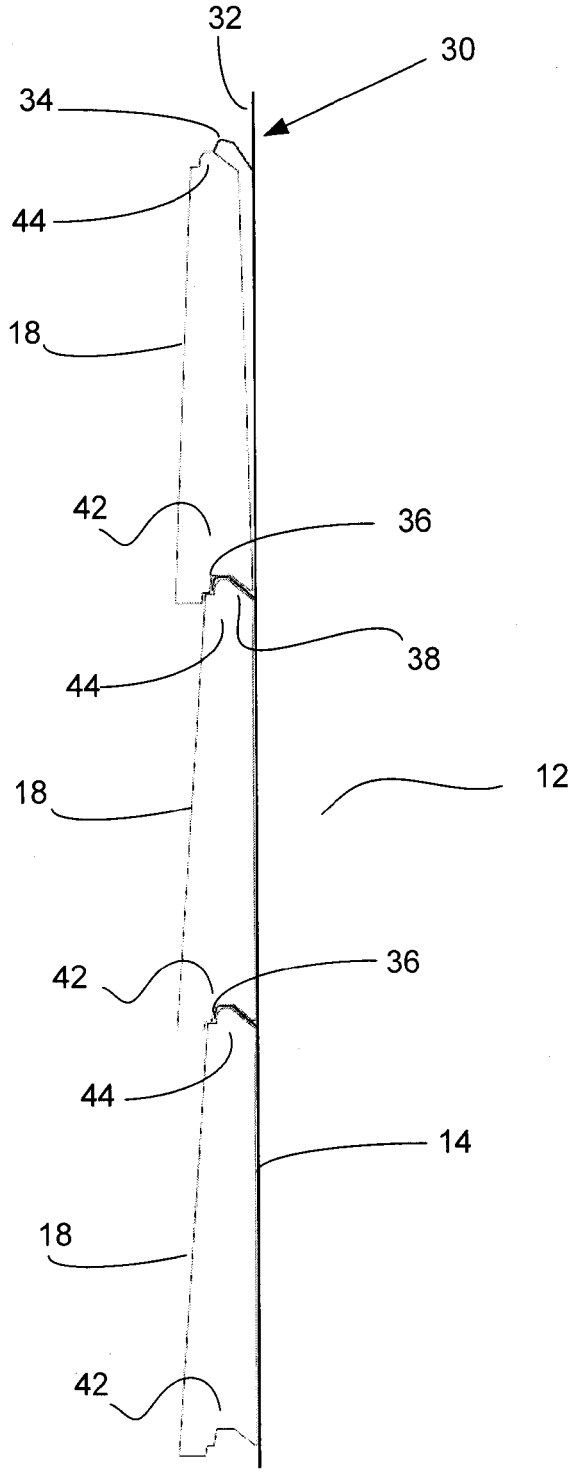
FIG. 3 is a side view of siding panels fastened to a surface by the fastening device of FIG. 2 according to an embodiment.
Figure 3A:
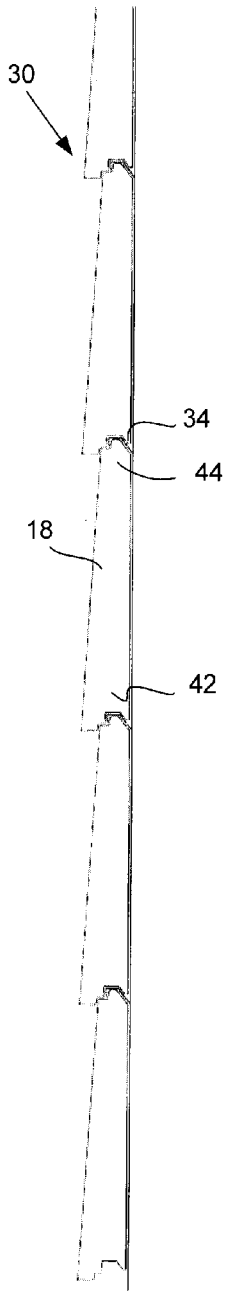
FIGS. 3A to 3E are side views of siding panels fastened to a surface by the fastening device according to other embodiments.
Figure 3B:
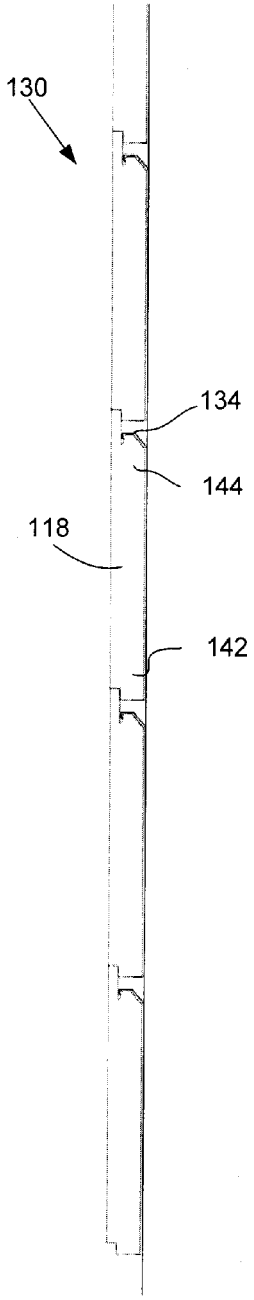
Figure 3C:
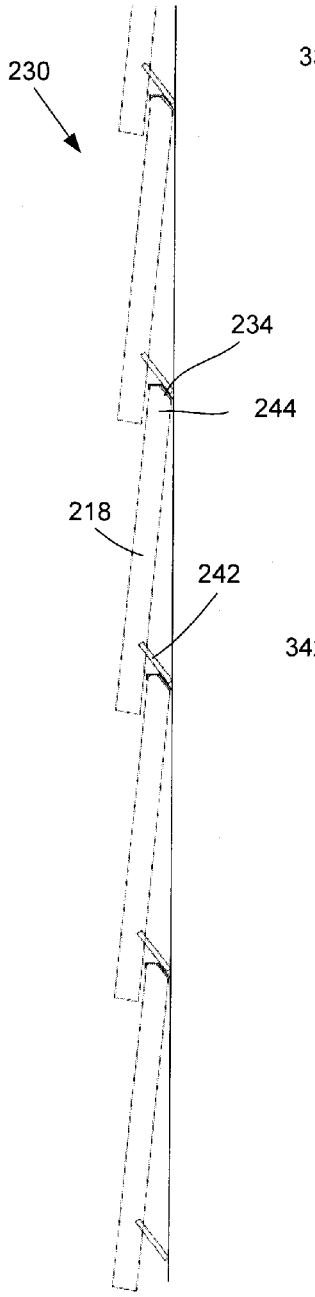
Figure 3D:
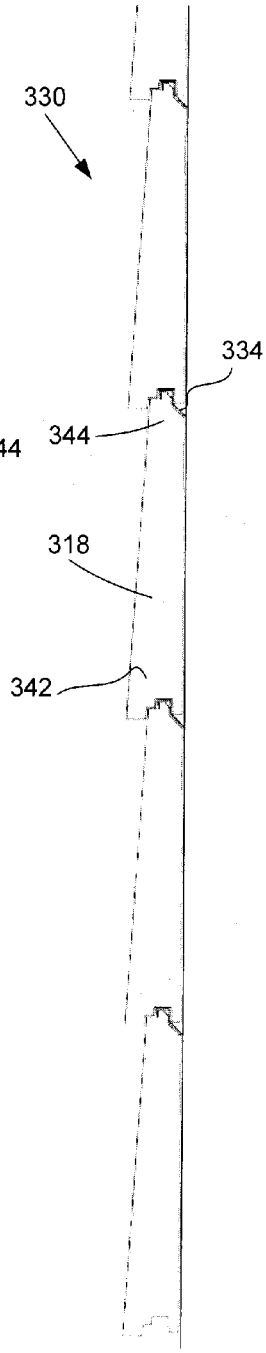
Figure 3E:
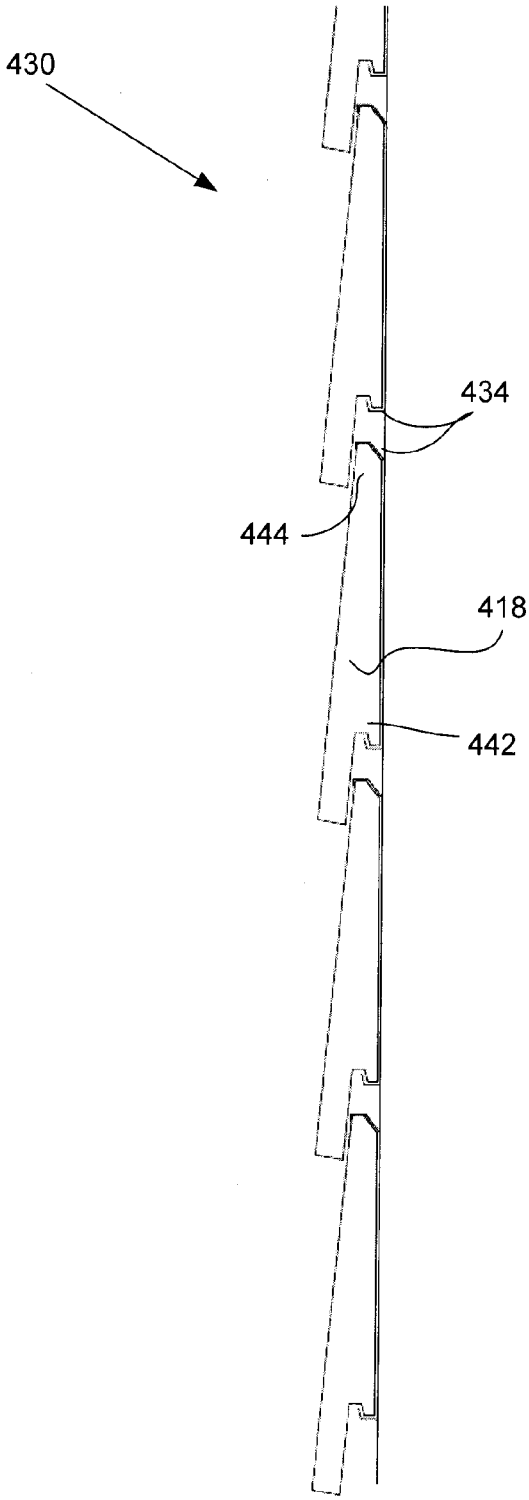

Now referring to FIG. 3, there is shown a side view of siding panels 18 fastened to a surface by the fastening device 30. During the fastening of the siding panel 18 to the surface 12, the second edge 42 of the siding panel 18 is secured in place, then the first edge 44 of the siding panel 18 is pushed against the braces 34 to displace the engaging portion 36 toward the surface 12 of the siding panels 18 until the brace 34 springs back to its original position and the first edge 44 of the siding panel 18 is engaged in the engaging portion 36 thereby fastening the one of the siding panels 18 to the surface 12.

The bottommost and middle siding panels 18 are shown installed between two consecutive braces 34. In this embodiment, the flexible portion 38 of a brace 34 engages and secures the second edge 42 of a siding panel 18.

The topmost siding panel 18 is shown ready to be installed with its second edge 42 in place on the brace 34 while the first edge 44 is pushing against the brace 34.

Each one of the siding panels 18 is substantially rigid and comprises a first edge 44 and a second edge 42. More particularly, the fastening device 30 comprises a strip 32 for installation on strapping 14 and braces 34, spaced along the strip 32 and extending outwardly therefrom. At least one of the braces 34 is for engaging the first edge 44 of one of a siding panel 18. As shown in FIGS. 2, 2A, 2B and 2C, the braces 34 each comprise an engaging portion 36 and a flexible portion 38. The engaging portion 36 extends from the flexible portion 38.

Although a given profile for the siding panels 18 is shown in FIG. 3, many other profiles which will work well are possible (see FIGS. 3A to 3E). Indeed, braces 34, 134, 234, 334 and 434 may take different shapes. Also, siding panels 18, 118, 218, 318 and 418 may respectively take on different forms to provide different embodiments for the fastening devices 30, 130, 230, 330 and 430. The same can be said about the particular shape of the braces. As long as the braces 34, 134, 234, 334 and 434 properly interact with the first and second edges of the siding panels respectively 18, 118, 218, 318 and 418. Of course, the distance between braces 34, 134, 234, 334 and 434 corresponds respectively to the distance between the first edges 44, 144, 244, 344, 444 and second edges 42, 142, 242, 342, 442 of each siding panel 18, 118, 218, 318 and 418.

Installation of siding panels 18 on a surface using the fastening device 30 is much easier and faster that using prior art techniques and devices.

Figure 4:
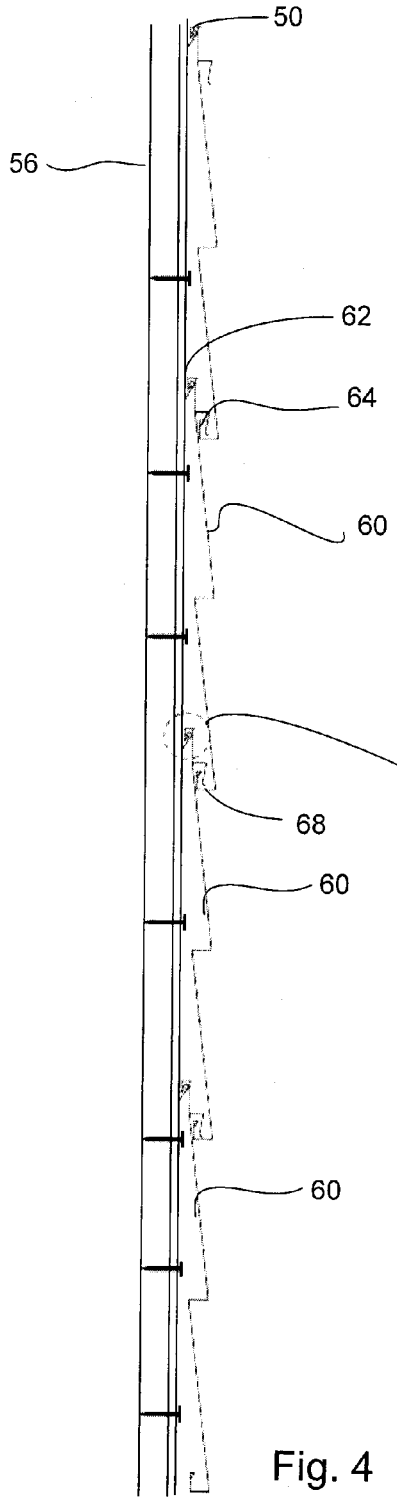
FIG. 4 is a side view of molded or folded sheet type siding for fastening to a surface by the fastening device according to an embodiment.

Referring to FIG. 4, there is shown a fastening device 50 according to another embodiment comprising a strip 56. The fastening device 50 is made of rigid material such as sheet metal comprising steel. The fastening device 50, shown in the embodiment of FIG. 4, is meant to be installed on strapping 14 or strapping 22 of FIG. 1. The fastening device 50 can be installed to strapping 14 or 22 using nails installed by hand or using a pneumatic gun. Any other means for fixing fastening device 30 to strapping 14 or 22 such as screws, glue, double-side or single-side tape, etc., or any combination thereof is acceptable.

Specifically referring to FIG. 4, there is shown a side view of a plurality of sheet type siding 60 fastened to a surface by the fastening device 50. The fastening device 50 is shown installed on strapping 14.

Figure 5:
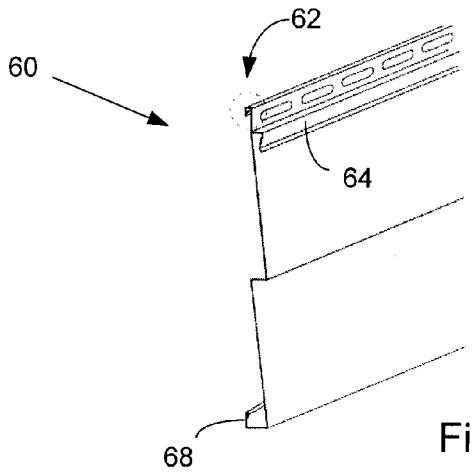
FIG. 5 is partial perspective view of molded or folded sheet type siding according to an embodiment.
Figure 6:
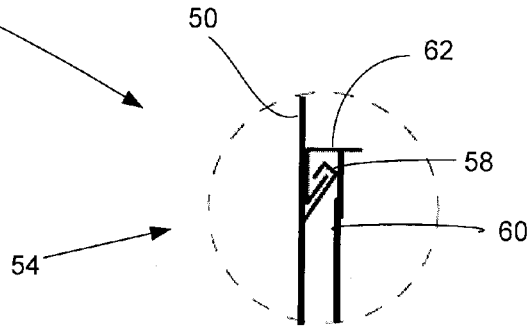
FIG. 6 is a partial side view of a portion of FIG. 4 detailing the interaction between the brace of the fastening device and the top back hook of the siding according to an embodiment.

Referring to FIGS. 4, 5 and 6, on the fastening device 50, braces 54 are regularly disposed along the strip 56. Each brace 54 has a hook portion 58. Each hook portion is for engaging a corresponding top back hook portion on the sheet type siding (described in more detail in FIGS. 5 and 6).

The sheet type siding 60 according to an embodiment is shown. In addition to a bottom back hook 68 and a front top hook 64, which are normally found on siding 60, siding 60 further includes a top back hook 62. Bottom back hook 68 and front top hook 64 function as they would normally in that, bottom back hook 68 of a siding for installation above an installed lower siding is made to interact with front top hook 64 of the installed lower siding. Top back hook 62 is made to interact with hook portion 58 to hold the top portion of the siding 60 to the strip 56 and hence to strapping 14.

Figure 8A:
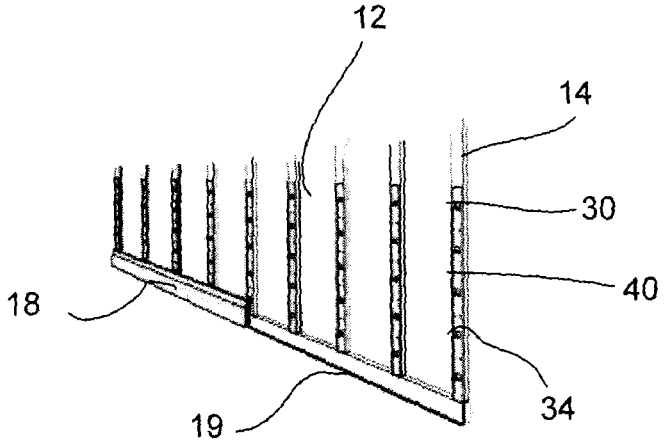
FIG. 8A is a perspective view of the fastening devices at one step of a method for fastening siding panels to a surface according to an embodiment.
Figure 8B:
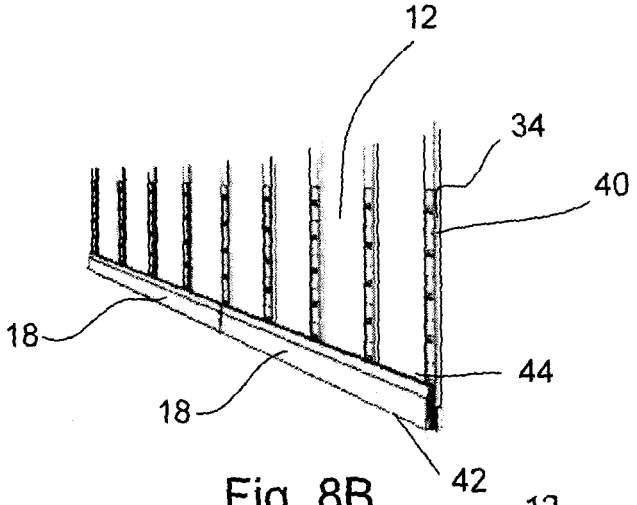
FIG. 8B is a perspective view of the fastening devices at another step of a method for fastening siding panels to a surface according to an embodiment.
Figure 8C:
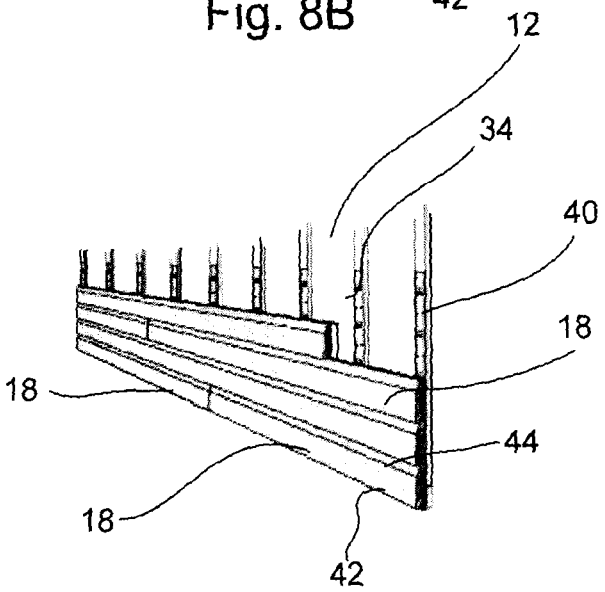
FIG. 8C is a perspective view of the fastening devices at another step of a method for fastening siding panels to a surface according to an embodiment.

Now referring to FIGS. 8A to 8C, according to an embodiment, the user uses a known method for fastening siding panels 18 to a surface 12. The user first installs the starting strip 19, or alternatively, he draws a level horizontal line on the surface. If he uses a starting strip 19, it will be easy to start installing the fastening devices 30 all at the same level by leaning the bottom of each fastening device 30. If he is not using a starting strip 19, the user will use a set of markings 40 from the fastening device 30 as a reference to level all the fastening devices 30. The known methods include but are not limited to using a chalk line with a regular level or a laser level.

When necessary, the starting strip 19 at level (see FIG. 8A) at a selected height on structure 15. The selected height may be determined by where the user wants a given siding panel 18 to be located relative to a part of the surface; i.e., the top or the bottom of the surface, an opening in the surface, etc. Then, the fastening devices 30 are installed by aligning the bottom part thereof with the top edge of starting strip 19. All markings 40 should form level horizontal lines since all fastening devices 30 are identical.

If no starting strip 19 is used, a first fastening device 30 is installed at a selected height. Once the surface is marked with a level horizontal line crossing one of the sets of markings 40, the user installs a fastening device 30 on all, or a majority of, the remaining strapping 14 with a set of markings 40 from each fastening device 30 crossing the horizontal line. Having all sets of markings 40 at the same relative distance from a respective brace 34 ensures that all braces form level horizontal lines. Using a nail gun for installing the fastening device 30 to the stripping is particularly useful.

The user then starts installing siding panels 18 starting at the bottom of the surface and then moves up from there to the row of siding panels immediately above (FIGS. 8A, 8B and 8C). Each siding panel 18 is installed simply by resting or securing the second edge 42 of a siding panel 18 on a row of braces 34. The first edge 44 of the siding panel 18 is then pushed against the row of braces 34 above it as shown in FIG. 3. The braces 34 are forced to move upward until the first edge 44 of the siding panel 18 crosses the engaging portion 36 of the braces 34 (FIG. 3). The engaging portion 36 of braces 34 will then secure the siding panel 18 in place. The series of views from left to right in FIG. 7 shows this process.

Figure 7:
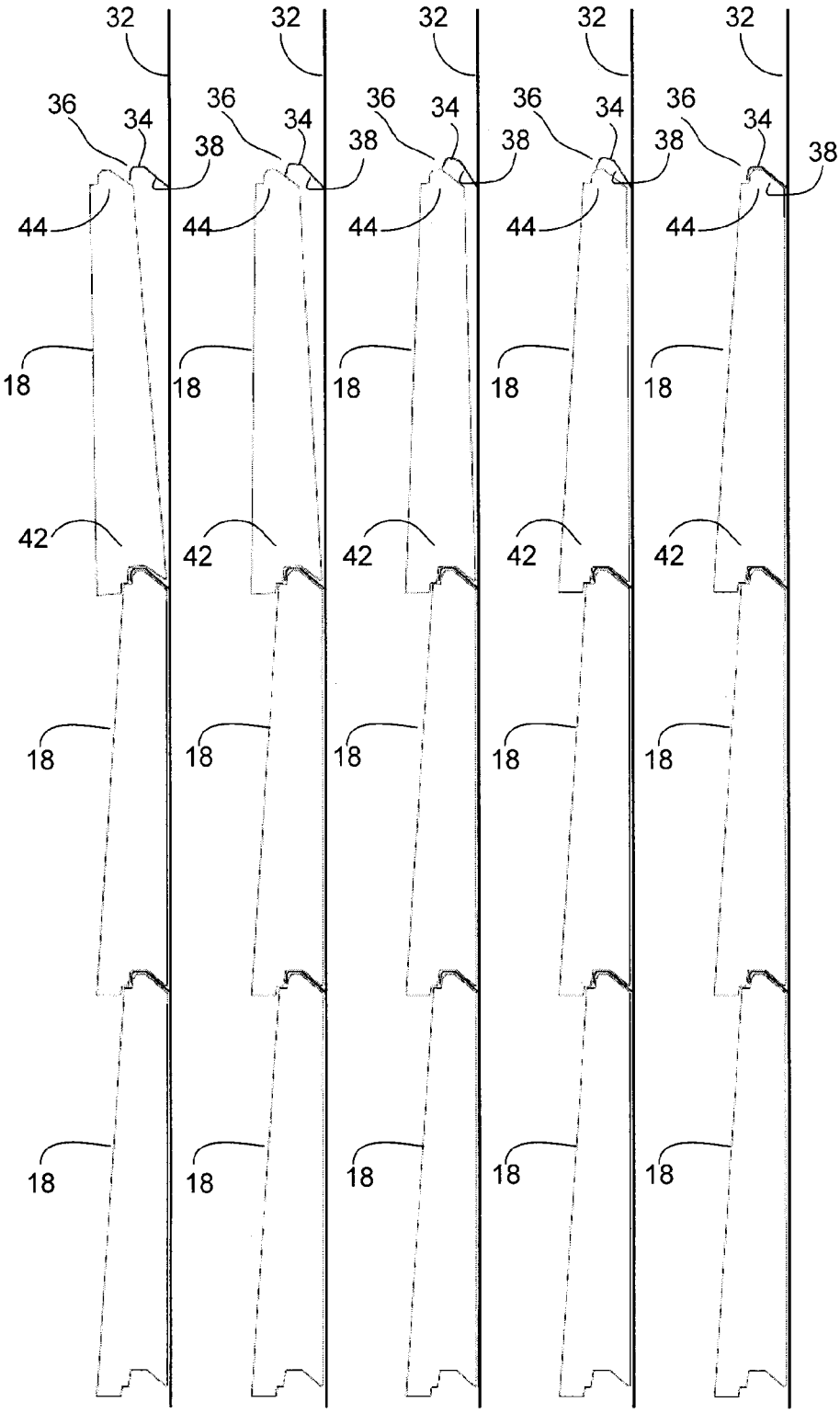
FIG. 7 is a side view of the fastening devices at different steps of a method for fastening siding panels to a surface according to an embodiment.

A shown in FIG. 7 more particularly, the method for fastening siding panels 18 to a surface comprises the steps of securing in place the second edge 42 of the one of the siding panels 18 on the first edge 44 of another one of the siding panels 18 and pushing against the at least one of the braces 34 the first edge 44 of the one of the siding panels 18 to displace the engaging portion 36 toward the surface 12 of the one of the siding panels 18 until the first edge 44 of the one of the siding panels 18 is engaged in the engaging portion 36 thereby fastening the one of the siding panels 18 to the surface 12.

Installing siding panels 18 using this technique can thus be achieved by one person without using nails through the siding panels.

Figure 9:
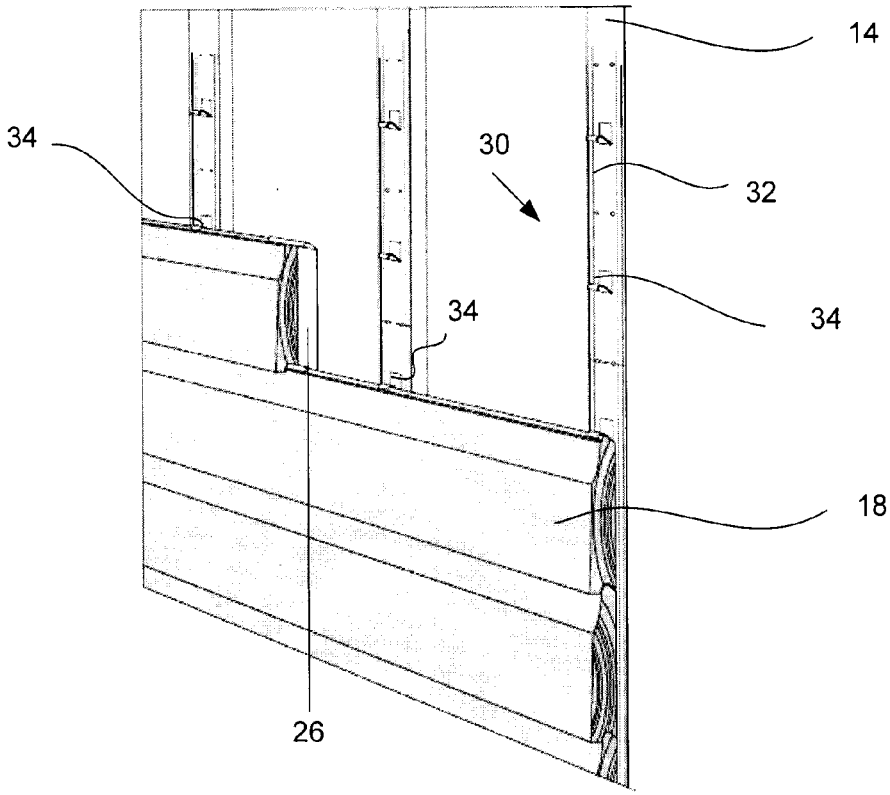
FIG. 9 is a partial perspective view of a fastening device according to an embodiment.
Figure 10:
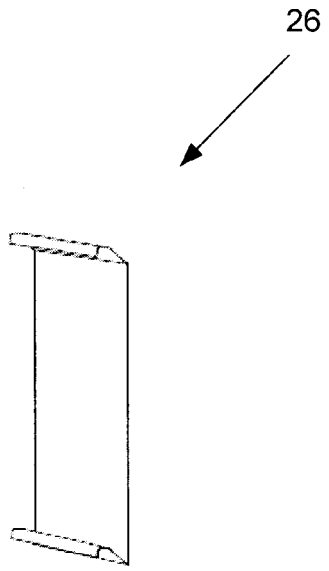
FIG. 10 is a perspective view of an union part for fixing together two siding panels according to an embodiment.

Now referring to FIG. 9, there is shown a fastening device 30 at a specific different step of the method for fastening siding panels 18 to a surface according to an embodiment. Additionally, there is shown in FIGS. 9 and 10 a union part 26 for joining two siding panels 18 end-to-end between the braces 34. It allows the users of the fastening device 30 to join two siding panels 18 between tow fastening devices. Indeed, there is no obligation to be on the strip 32 to join two siding panels 18 end-to-end.

Figure 11:
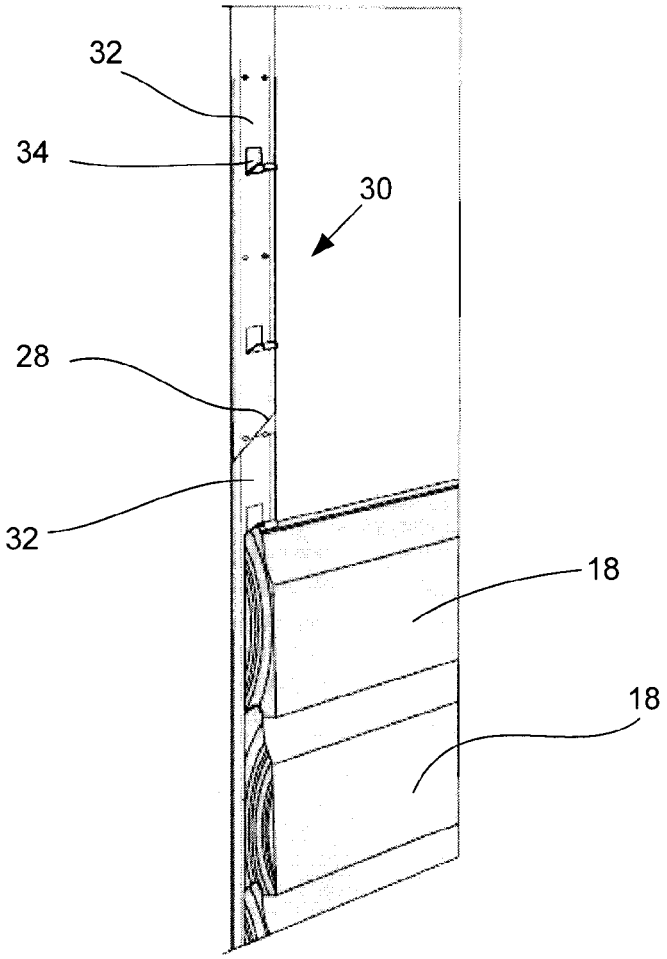
FIG. 11 is another perspective view of a fastening device according to an embodiment.
Figure 12:
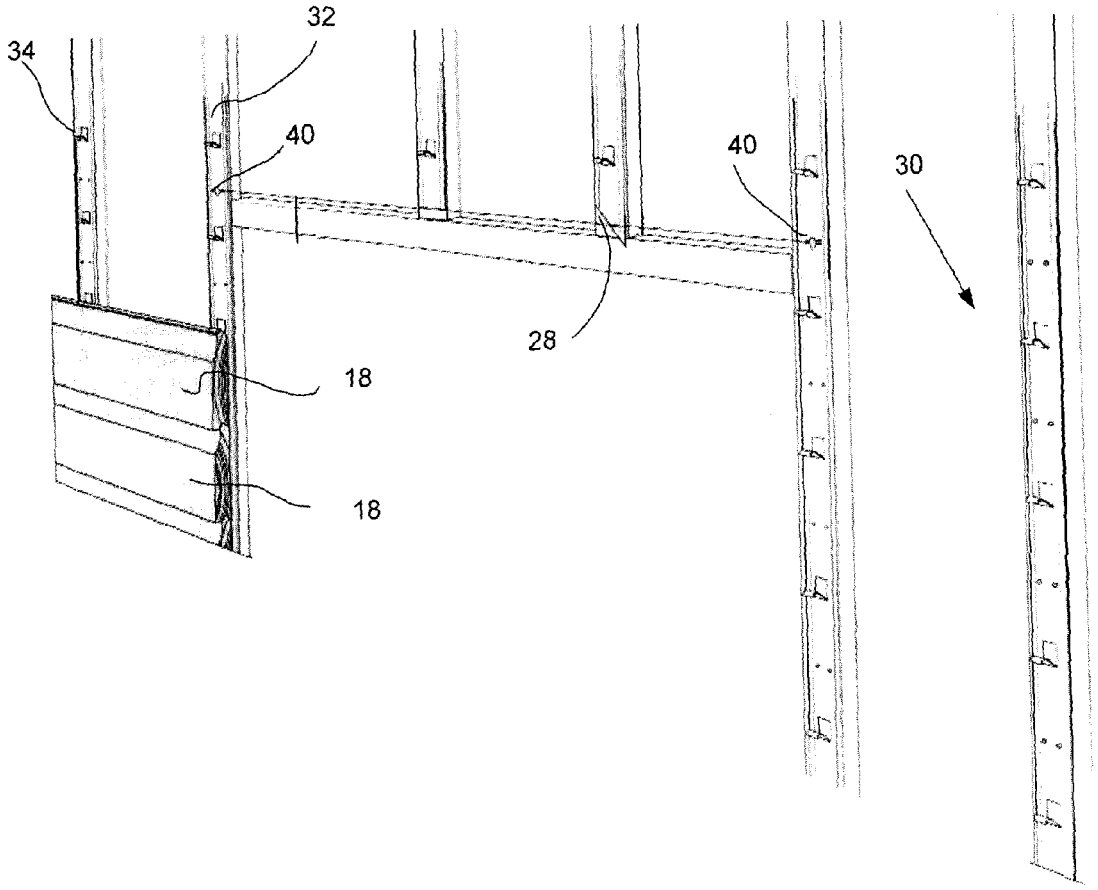
FIG. 12 is a partial perspective view of a structure with fastening device according to an embodiment.

Moreover, FIGS. 11 and 12 show a fastening device with two siding panels 18 installed between braces 34 of the strip 32. Additionally, FIGS. 11 and 12 show an inclined cut 28 for allowing the strips 32 to be aligned when installed.

FIG. 12 shows, in a method for fastening siding panels to a surface, the use of markings 40 of two fastening devices 30 to draw a line and start the installation of two other fastening devices 30 from their respective markings 40.

It should be noted that the fastening devices 30 and 50 described herein are adapted to work with all types of exterior surface siding such as genuine wood, wood fiber, fiber cement, vinyl, composite materials, aluminum, etc. as well as interior products such as wood slats, decorative tiles, ceiling panels, etc.

Figure 13:
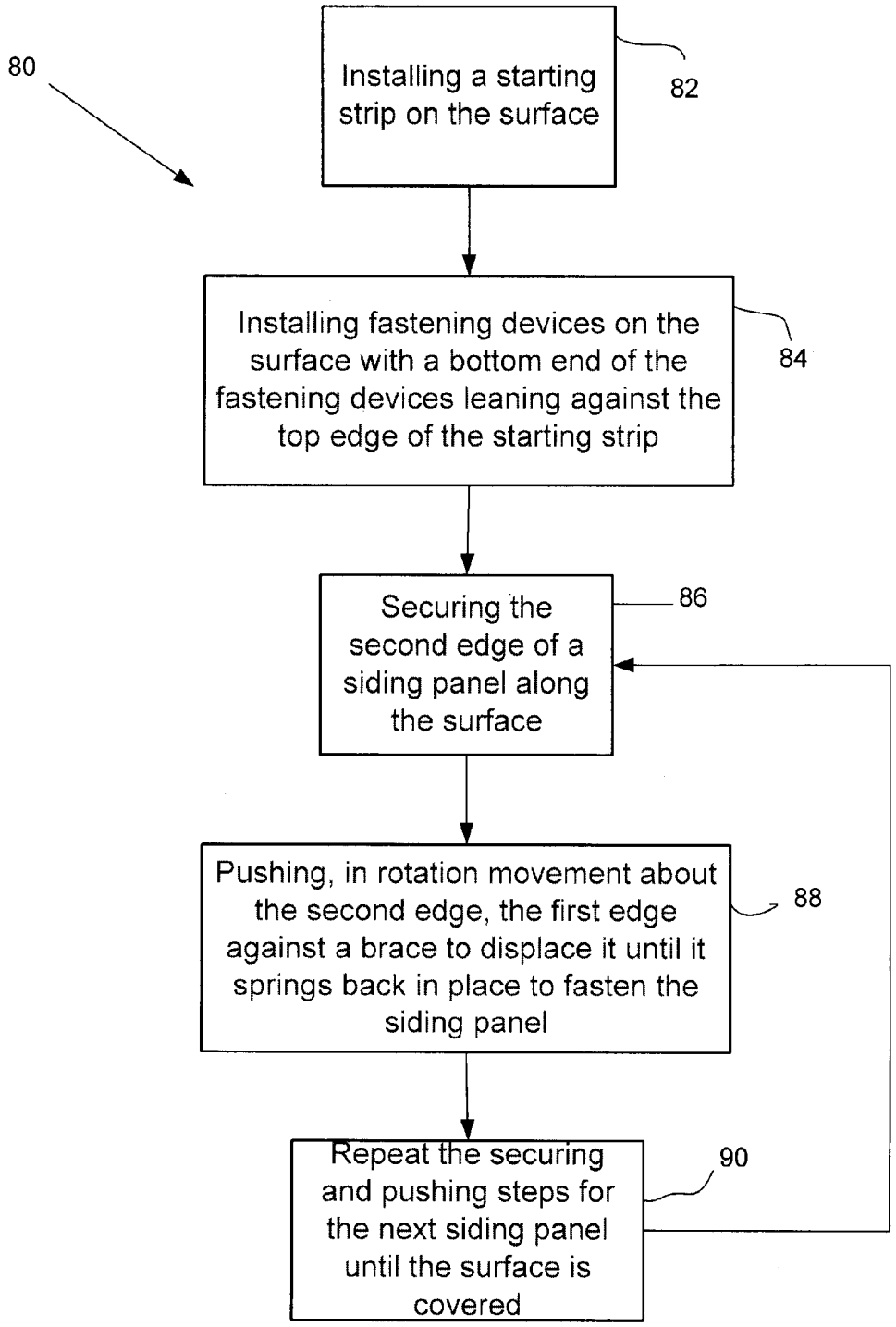
FIG. 13 is a block diagram describing an embodiment of a method for fastening siding panels to a surface.

Now turning to FIG. 13, there is described an embodiment of a method 80 for fastening to a surface, siding panels comprising a first edge and a second edge. The method 80 comprises: installing a starting strip on the surface in the same longitudinal direction as the intended longitudinal direction of the siding panels (step 82); installing, on the surface, identical longitudinal fastening devices, each comprising braces, while leaning a bottom end of the identical longitudinal fastening devices against a top edge of the starting strip during installation thereof to the surface thereby ensuring all braces on a given identical longitudinal fastening devices are aligned with the braces of other identical longitudinal fastening devices (step 84); securing the second edge of a siding panel along the surface and perpendicularly to the longitudinal fastening devices (step 86); pushing, in a rotation movement about the second edge, the first edge of the siding panel against one of the braces to displace the one of the braces toward the surface until the one of the braces springs back to its original position and the first edge is engaged in the one of the braces thereby fastening the one of the siding panels to the surface (step 88); and repeating the securing and pushing steps for the siding panel to be fastened immediately adjacent the first edge of an installed siding panel until the surface is covered (step 90).

While preferred embodiments have been described above and illustrated in the accompanying drawings, it will be evident to those skilled in the art that modifications may be made therein without departing from the essence of this disclosure. Such modifications are considered as possible variants comprised in the scope of the disclosure.

The invention claimed is:

1. A fastening device for fastening siding panels to a substantially vertical surface, each one of the siding panels comprising a first edge and a second edge opposite the first edge, the fastening device comprising:

a strip for attachment to the substantially vertical surface, the strip defining a top end and a bottom end; and braces spaced along the strip and extending outwardly therefrom, at least one of the braces for engaging the first edge of one of the siding panels, the braces each comprising:

a flexible portion upwardly extending from the strip towards the top end of the strip when the strip is installed on the substantially vertical surface;

an engaging portion extending from the flexible portion, the engaging portion defining a concave surface and a convex surface, the concave surface adapted to receive therein the first edge of the one of the siding panels and the convex surface adapted to receive thereon the second edge of another one of the siding panels; and a substantially planar push portion downwardly extending from the engaging portion in a vertical plane which is parallel to the substantially vertical surface.

2. The fastening device of claim 1, wherein the braces are regularly spaced along the strip.

3. The fastening device of claim 1, wherein the braces are irregularly spaced along the strip.

4. The fastening device of claim 1, wherein the braces comprise two braces to form a union part to join two siding panels in an end-to-end relationship.

5. The fastening device of claim 1, wherein the strip and braces are made from the same piece of material and form a single unitary part.

6. The fastening device of claim 5, wherein the braces are cutout and folded from the same piece of material, the braces thereby comprising folds.

7. The fastening device of claim 6, wherein the folds comprise at least two folds, namely a first fold between the strip and the flexible portion and a second fold between the flexible portion and the engaging portion.

8. The fastening device of claim 7, wherein the flexible portion is comprised between the first and the second folds.

9. The fastening device of claim 8, wherein a distance between the first and the second folds is greater than a distance between any consecutive folds thereafter or than a length of material on the braces after a last fold thereby ensuring that the flexible portion will flex to displace the engaging portion.

10. The fastening device of claim 5, wherein the same unitary piece of material comprises steel.

11. The fastening device of claim 1, wherein the substantially planar push portion is in a first plane and the flexible portion is in a second plane which is substantially parallel to the first plane.

12. The fastening device of claim 1, wherein the strip comprises a portion for being perforated by nails for fixing the strip on the substantially vertical surface.

13. The fastening device of claim 1, wherein the strip comprises markings disposed at a fixed longitudinal distance of each brace for facilitating the positioning of the fastening device on the substantially vertical surface.

14. The fastening device of claim 13, wherein the strip has a longitudinal direction and the markings comprise pairs of markings wherein the markings in each of the pairs of markings form a line that is perpendicular to the longitudinal direction of the strip.

15. The fastening device of claim 1, wherein the strip has a longitudinal direction and the braces have a width in a direction which is perpendicular to the longitudinal direction of the strip and wherein the first edge of the one of the siding panels is parallel to a longitudinal direction of the one of the siding panels, the longitudinal direction of the strip and the longitudinal direction of the siding panels are therefore generally perpendicular to each other.

16. The fastening device of claim 1, wherein the strip is for vertical attachment to the substantially vertical surface while the siding panels are for horizontal installation.

17. The fastening device of claim 1, further comprising at least one of ridges, wings and cut-out extensions extending from the strip for exerting an outward positive pressure on the siding panels.

18. A method for fastening to a surface, siding panels comprising a first edge and a second edge opposite the first edge, the method comprising:

installing, on the surface and at the same level, identical longitudinal fastening devices each comprising braces;

securing the second edge of a siding panel along the surface and perpendicularly to the longitudinal fastening devices;

pushing, in a rotation movement about the second edge, the first edge of the siding panel against a substantially planar push portion downwardly extending from an engaging portion one of the braces to displace the one of the braces toward the surface until the one of the braces springs back to its original position and the first edge is engaged in the one of the braces thereby fastening the one of the siding panels to the surface; and repeating the securing and pushing steps for the siding panel to be fastened immediately adjacent the first edge of an installed siding panel until the surface is covered.

19. The method of claim 18, further comprising installing a starting strip on the surface in the same longitudinal direction as the intended longitudinal direction of the siding panels, and wherein the installing the identical longitudinal fastening devices comprises leaning a bottom end of the identical longitudinal fastening devices against a top edge of the starting strip during installation thereof to the surface thereby ensuring all braces on a given identical longitudinal fastening devices are aligned with the braces of other identical longitudinal fastening devices.

20. The fastening device of claim 1, wherein a portion extends inward from the planar push portion toward a vertical the vertical surface.

* * * * *